United States Patent [19]

Weigel

[11] Patent Number: 4,585,734

[45] Date of Patent: Apr. 29, 1986

[54] PHOTOTHERMOGRAPHIC TONERS

[75] Inventor: David C. Weigel, White Bear Lake, Minn.

[73] Assignee: Minnesota Mining and Manufacturing Company, St. Paul, Minn.

[21] Appl. No.: 697,342

[22] Filed: Feb. 1, 1985

[51] Int. Cl.[4] ..... G03C 1/02

[52] U.S. Cl. ..... 430/619; 430/620; 430/965

[58] Field of Search ..... 430/619, 620, 965, 617

[56] References Cited

U.S. PATENT DOCUMENTS

| | | | |
|---|---|---|---|
| 3,080,254 | 3/1963 | Grant | 430/616 |
| 3,672,904 | 6/1972 | de Mauriac | 430/350 |
| 3,847,612 | 11/1974 | Winslow | 96/67 |
| 3,980,482 | 9/1976 | Reece | 96/114.1 |
| 4,123,282 | 10/1978 | Winslow | 96/114.1 |
| 4,144,072 | 3/1979 | Ikenoue et al. | 430/965 |
| 4,201,582 | 5/1980 | White | 430/351 |
| 4,220,709 | 9/1980 | de Mauriac | 430/619 |
| 4,452,885 | 6/1984 | Nozawa et al. | 430/619 |

*Primary Examiner*—Won H. Louie

*Attorney, Agent, or Firm*—Donald M. Sell; James A. Smith; Mark A. Litman

[57] ABSTRACT

Certain effective toning systems for silver halide/silver salt/reducing agent photothermographic imaging materials tend to bleach the final image. The presently disclosed toning system of phthalazine and an active-hydrogen containing heterocyclic compound is more stable than some previous toners.

20 Claims, No Drawings

PHOTOTHERMOGRAPHIC TONERS

BACKGROUND OF THE INVENTION

1. Field of the Invention

The present invention relates to dry silver photothermographic imaging materials and to toners used therein.

2. Prior Art

Photosensitive, heat-developable, dry silver sheet materials, as described for example in U.S. Pat. Nos. 3,457,075 and 3,839,049, contain a photosensitive silver halide catalyst-forming means in catalytic proximity with a heat sensitive combination of a light stable organic silver compound and a reducing agent therefor. When struck by light, the silver halide catalyst-forming means produces silver nuclei which serve to catalyze the reduction of the organic silver compound, e.g., silver behenate, by the reducing agent at elevated temperatures. To improve the image density and color it has been found desirable to include toners in the sheet construction. Phthalimide has been known as such a toner.

In U.S. Pat. No. 3,080,254, phthalazinone is described as a toner for dry silver sheets. Phthalazinone, however, has been found to cause slight dusting that becomes noticeable during heat development of large numbers of the exposed sheets. The dusting problem can be avoided by using as toner a combination of an imidazole and phthalic acid, naphthalene-2,3-dicarboxylic acid of phthalamic acid, as described in U.S. Pat. No. 3,847,612, if a hindered phenolic reducing agent for silver ion is also present in the sheet. The resulting dry silver sheets tend to have lower optical speed and have lower light stability after development than sheets containing phthalazinone toner.

U.S. Pat. No. 4,123,282 discloses the use of a combination of phthalazine and aromatic acids as a toner system for providing dense, dark images in dry silver photothermographic emulsions. The aromatic acids tend to react with developer, dyes and other ingredients in the emulsion thereby reducing the shelf-stability of the emulsions.

BRIEF DESCRIPTION OF THE INVENTION

In accordance with the practice of the present invention, it has now been found possible to provide photosensitive, heat-developable, dry silver imaging sheets which give dense black images, do not emit dust-forming vapors during development, have good light stability after development, are useful even in dry silver sheets containing relatively weak reducing agents (i.e., reducing agents which, without a toner in a dry silver sheet, produce very faint yellow rather than black images), and have good optical speed comparable to that obtained when phthalazinone is used as toner. Furthermore, the toner system has a reduced reactivity to addenda in the emulsion such as developers, sensitizing dyes, and acutance dyes. This is achieved by using as toner a combination of phthalazine (including compounds which generate phthalazine upon heating, such as an adduct of phthalazine and maleic anhydride) and at least one active-hydrogen containing heterocyclic compound. None of the compounds used in this toner combination have been found to be effective as toners when used alone.

Substituted phthalazine compounds in which the carbon atoms adjacent the azo nitrogen are substituted with halogen, alkyl, alkoxy, nitro, etc. and pyridazine are surprisingly not operative in the toner system of this invention.

DETAILED DESCRIPTION OF THE INVENTION

The use of phthalazine in combination with heterocyclic compounds having an active hydrogen on the ring itself has been found to provide a good toner system for dry silver photothermographic emulsions. The active hydrogen-containing heterocyclic compounds are less reactive towards other essential ingredients than the aromatic acids of U.S. Pat. No. 4,123,282. This also allows for the use of phthalazine which does not dust out on the surface of the photographic element as does phthalazinone.

Active hydrogen-containing heterocyclic compounds according to the present invention are those 5-, 6-, or 7-membered heterocyclic compunds having C, O, S, N, or Se ring atoms (with no more than one of S or Se in a 5-membered ring, and no more than two of O, S or Se in a 6-, or 7-membered ring) in which a hydrogen atom attached to a ring atom can be removed by contact or dissolution with distilled water in an amount equal to 0.1 Molar to provide a pH below 7.0. Generally the compound should also provide a pH above 2.0. Preferably the pH is between 3.0 and 6.5, and most preferably between 4.5 and 6.0. Typical examples of such active hydrogen-containing compounds are phthalimide, naphthalimide, pyrazole, benzopyrazole, saccharin, succinimide, and 4-keto-3H-1,2,3-benzotriazine. These compounds do not need to have carboxylic groups as the active hydrogen may be on a ring nitrogen atom. Preferably such rings are composed of only C, N and one of O or S ring atoms and most preferably only C and N ring atoms with no more than 3N atoms.

These active hydrogen heterocyclic compounds may be used to replace all or part of the aromatic acids needed in the toner system of U.S. Pat. No. 4,123,282. Those acids are represented by the formula $$R—A—R^1$$

wherein A is phenyl or naphthyl and R and $R^1$ are substituents on the 2- or 3-positions of A and are selected from —COOH and —$CH_2COOH$. Anhydrides of these acids are also included within the terms aromatic acids. The phenyl or naphthyl group of the acid may preferably have in the 4 or 5 positions thereof an electron donating group selected from alkyl and alkoxy of 1–20 carbon atoms. More preferably, the groups are 1–5 carbon atoms.

The amount of toner material may be varied from one construction and formulation to the next. It is therefore desirable to incorporate sufficient toner to produce the desired image benefits with minimum adverse effect on such desirable properties as shelf life. With the weak reducing agents or developers, such as the hindered phenols, a larger amount of toner should be employed than with the stronger reducing agents, such as methyl gallate, hydroquinone and methoxy hydroxy naphthalene. Toner concentration will also vary with the proportion of silver salts and other reactants as well as with the thickness of the coating and developing conditions, e.g., heat development time and temperature. Thus, for example, one construction may require a temperature of 260° F. (126° C.) with a dwell time of 3 seconds, while another may required 300° F. (147° C.) for 5 seconds, and still another may need 230° F. (110° C.) for 35 seconds, and the amount of toner and type of reducing agent may be varied accordingly. In most constructions the toner concentrations will fall in the range of 0.027 to 0.40, preferably in the range of 0.027 to 0.35 moles of phthalazine and 0.007 to 0.35, preferably in the range of 0.007 to 0.28 moles of the active hydrogen containing heterocyclic toner (possibly replaced with up to 50 mole percent of the above-described toner acid or anhydride) per mole of total silver. Only a minor amount of the total silver is present as the photosensitive silver halide, the remaining silver being present as the light-stable organic silver compound.

Photothermographic dry silver emulsions are usually constructed as one or two layers on a substrate. Single layer constructions must contain the silver source material, the silver halide, the developer and binder as well as optional additional materials such as toners, coating aids and other adjuvants. Two-layer constructions must contain the silver source and silver halide in one emulsion layer (usually the layer adjacent the substrate) and the other ingredients in the second layer or both layers.

The silver source material, as mentioned above, may be any material which contains a reducible source of silver ions. Silver salts of organic acids, particularly long chain (10 to 30, preferably 15 to 28 carbon atoms) fatty carboxylic acids are preferred. Complexes of organic or inorganic silver salts wherein the ligand has a gross stability constant between 4.0 and 10.0 are also desirable. The silver source material should constitute from about 20 to 70 percent by weight of the imaging layer. Preferably it is present as 30 to 55 percent by weight. The second layer in a two-layer construction would not affect the percentage of the silver source material desired in the single imaging layer.

The silver halide may be any photosensitive silver halide such as silver bromide, silver iodide, silver chloride, silver bromoiodide, silver chlorobromoiodide, silver chlorobromide, etc., and may be added to the emulsion layer in any fashion which places it in catalytic proximity to the silver source. The silver halide is generally present as 0.75 to 15 percent by weight of the imaging layer, although larger amounts up to 20 or 25 percent are useful. It is preferred to use from 1 to 10 percent by weight silver halide in the imaging layer and most preferred to use from 1.5 to 7.0 percent.

The reducing agent for silver ion may be any material, preferably organic material, which will reduce silver ion to metallic silver. Conventional photographic developers such as phenidone, hydroquinones, and catechol are useful, but hindered phenol reducing agents are preferred. The reducing agent should be present as 1 to 10 percent by weight of the imaging layer. In a two-layer construction, if the reducing agent is in the second layer, slightly higher proportions, of from about 2 to 15 percent tend to be more desirable.

The toner system materials of the present invention may be present, for example, in amounts of from 0.2 to 10 percent by weight of all silver-bearing components.

The binder may be selected from any of the well-known natural and synthetic resins such as gelatin, polyvinyl acetals, polyvinyl chloride, polyvinyl acetate, cellulose acetate, polyolefins, polyesters, polystyrene, polyacylonitrile, polycarbonates, and the like. Copolymers and terpolymers are of course included in these definitions. The polyvinyl acetals, such as polyvinyl butyral and polyvinyl formal, and vinyl copolymers such as polyvinyl acetate/chloride are particularly desirable. The binders are generally used in a range of from 20 to 75 percent by weight of each layer, and preferably about 30 to 55 percent by weight.

For use on paper or other non-transparent backings it is found convenient to use silver half-soaps, of which an equimolar blend of silver behenate and behenic acid, prepared by precipitation from aqueous solution of the sodium salt of commercial behenic acid and analyzing about 14.5 percent silver, represents a preferred example. Transparent sheet materials made on transparent film backing require a transparent coating and for this purpose the silver behenate full soap, containing not more than about four or five percent of free behenic acid and analyzing about 25.2 percent silver, may be used. Other components, such for example as coloring, opacifiers, extenders, special sensitizing dyes, etc. may be incorporated as required for various specific purposes. Antifoggants, such as mercuric salts and tetrachlorophthalic anhydride, may also be included in the formulation.

EXAMPLES 1-2

A first coating composition consisting of 127 grams half soap homogenate, 175 grams toluene, 28.1 grams poly(vinyl butyral), 3 ml of Hg Acetate (0.2 g Hg/4 ml methanol), and 12 ml of $CaBr^2$ (2.36 g/100 ml methanol) was prepared. A second coating composition of 0.2 g syringaldazine, 0.2 g phthalazine, 0.4 g phthalimide, and 30 grams of a 20% by weight solution of a vinyl chloride/vinyl acetate (80/20) copolymer in methylethylketone was also prepared. The first coating composition was applied at a top coating weight of about 1.7 g/ft$^2$ and dried for 2½ minutes at 89° C. The second composition was coated at 0.25 g/ft$^2$ and dried for 2½ minutes at 89° C. The resulting article was exposed (1,200 foot-candle-seconds of incident tungsten light at 28° C. and 60% relative humidity) through a 0-4 continuous wedge. The initial $D_{min}$ was 0.15 and the initial $D_{max}$ was 2.69.

After two hours of aging at 50° C. and 50% relative humidity, $D_{min}$ was 0.14 and $D_{max}$ was 1.72.

When the phthalimide was replaced with an equal molar amount of phthalic acid, the $D_{max}$ was much lower due to reaction of the syringaldazine with the acid.

EXAMPLES 3-8

Example 1 is repeated except that the phthalamide is replaced with equal molar portions of naphthalimide, pyrazole, benzopyrazole, saccharin, succinimide, and 4-keto-3H-1,2,3-benzotriazine. Each of these compounds shows improved $D_{max}$ stability over the phthalic acid. The saccharin is expected to perform the worst in stabilizing the $D_{max}$ because its pH is about 1.8 which is low enough to effect some bleaching. It is for that reason that pH levels above 2.0 are generally used. The utility of all these compounds evidences the generic utility of free-hydrogen containing heterocyclics according to the present invention.

What is claimed is:

1. In a photosensitive, heat-developable, dry silver sheet material containing an image-forming system including a preformed photosensitive silver halide catalyst-forming means and, as heat sensitive image forming means, an organic silver compound and a reducing agent therefor, the oxidation reduction reaction of which to produce a visible image is accelerated by said catalyst, and sufficient toner to increase the density of said visible image, the improvement characterized by said toner being a mixture of (a) phthalazine and (b) at least one active hydrogen containing heterocyclic compound comprising a 5-, 6-, or 7-membered heterocyclic ring having only C, N, S, O, and Se ring atoms.

2. The dry silver sheet material of claim 1 wherein said reducing agent is a weak reducing agent.

3. The dry silver sheet material of claim 1 wherein said (b) is phthalimide.

4. The dry silver sheet material of claim 1 wherein said (b) is succinimide.

5. The dry silver sheet material of claim 1 wherein said (b) is pyrazole.

6. In a photosensitive, heat-developable, dry silver sheet material containing an image-forming system including a preformed photosensitive silver halide catalyst-forming means and, as heat sensitive image forming means, an organic silver compound and a reducing agent therefor, the oxidation reduction reaction of which to produce a visible image is accelerated by said catalyst, and sufficient toner to increase the density of said visible image, the improvement characterized by said toner being a mixture of (a) phthalazine and (b) 4-keto-3H-1,2,3-benzotriazine.

7. The dry silver sheet material of claim 1 wherein there is also from 1–50 mole percent of toner component (b) of at least one acid of the formula:

$$R—A—R_1$$

wherein A is phenyl or naphthyl and R and $R_1$ are selected from —COOH and $CH_2COOH$, R and $R^1$ bonded respectively to the 2 and 3 positions of $A_1$ and anhydrides of said acid $R—A—R_1$.

8. The dry silver sheet material of claim 7 wherein there is from 1–20 mole percent of said acid per mole of said heterocyclic compound.

9. The dry silver sheet material of claim 8 wherein there is from 1–10 mole percent of said acid per mole of said heterocyclic compound.

10. The dry silver sheet material of claim 1 wherein there is no acid of the formula:

$$R—A—R_1$$

wherein A is phenyl or naphthyl and R and $R_1$ are selected from —COOH and $CH_2COOH$, R and $R^1$ bonded respectively to the 2 and 3 positions of $A_1$ and anhydrides of said acid $R—A—R_1$ present in said sheet material.

11. The dry silver sheet of claim 1 wherein said toner mixture comprises from 0.2 to 10 percent by weight of all silver-bearing components.

12. The dry silver sheet of claim 2 wherein said toner mixture comprises from 0.2 to 10 percent by weight of all silver-bearing components.

13. The dry silver sheet of claim 7 wherein said toner mixture comprises from 0.2 to 10 percent by weight of all silver-bearing components.

14. The dry silver sheet of claim 8 wherein said toner mixture comprises from 0.2 to 10 percent by weight of all silver-bearing components.

15. The dry silver sheet of claim 9 wherein said toner mixture comprises from 0.2 to 10 percent by weight of all silver-bearing components.

16. The dry silver sheet of claim 10 wherein said toner mixture comprises from 0.2 to 10 percent by weight of all silver-bearing components.

17. The sheet material of claim 2 wherein said heterocyclic compound provides a pH of greater than 2.0 and less than 7.0 in distilled water at a concentration of 0.1M.

18. The sheet material of claim 10 wherein said heterocyclic compound provides a pH of greater than 2.0 and less than 7.0 in distilled water at a concentration of 0.1M.

19. The sheet material of claim 12 wherein said heterocyclic compound provides a pH of greater than 2.0 and less than 7.0 in distilled water at a concentration of 0.1M.

20. The sheet material of claim 16 wherein said heterocyclic compound provides a pH of greater than 2.0 and less than 7.0 in distilled water at a concentration of 0.1M.

* * * * *